US009045246B2

(12) United States Patent
Nishida et al.

(10) Patent No.: US 9,045,246 B2
(45) Date of Patent: Jun. 2, 2015

(54) CONTAINER USABLE AS A DEEP BOTTOM AND SHALLOW BOTTOM TYPE CONTAINER, AND MANUFACTURING METHOD THEREOF

(75) Inventors: Koji Nishida, Kanagawa (JP); Kunitake Kobayashi, Tokyo (JP)

(73) Assignees: KABUSHIKI KAISHA GREENPACKS, Tokyo (JP); POLYMER ASSOCIATES GODOKAISHA, Kanagawa (JP)

( * ) Notice: Subject to any disclaimer, the term of this patent is extended or adjusted under 35 U.S.C. 154(b) by 0 days.

(21) Appl. No.: 14/126,265

(22) PCT Filed: Jun. 21, 2011

(86) PCT No.: PCT/JP2011/064135

§ 371 (c)(1),
(2), (4) Date: Dec. 13, 2013

(87) PCT Pub. No.: WO2012/176279

PCT Pub. Date: Dec. 27, 2012

(65) Prior Publication Data

US 2014/0110463 A1 Apr. 24, 2014

(51) Int. Cl.
*B65D 3/22* (2006.01)
*B65D 3/28* (2006.01)
(Continued)

(52) U.S. Cl.
CPC ..... *B65D 5/0005* (2013.01); *B65D 3/28* (2013.01); *B65D 3/22* (2013.01); *B65D 5/24* (2013.01); *B65D 5/029* (2013.01); *B31B 1/16* (2013.01); *B31B 1/30* (2013.01); *B31B 3/74* (2013.01)

(58) Field of Classification Search
CPC ..... B65D 3/22; B65D 3/28; B65D 5/005; B65D 5/029; B65D 5/24; B31B 1/16; B31B 1/30; B31B 3/74
See application file for complete search history.

(56) References Cited

U.S. PATENT DOCUMENTS 396,028 A * 1/1889 Colhapp ..... 229/4.5
991,246 A * 5/1911 Rosenfeld ..... 229/400
(Continued)

FOREIGN PATENT DOCUMENTS

EP 1147989 B1 4/2001
GB 629430 * 9/1949 ..... B65D 41/14
(Continued)

OTHER PUBLICATIONS

International Search Report for PCT/JP2011/064135 dated Sep. 13, 2011.
(Continued)

*Primary Examiner* — Gary Elkins
(74) *Attorney, Agent, or Firm* — Pearne & Gordon LLP

(57) ABSTRACT

To provide a container usable as a deep bottom- and shallow bottom-type container by changing between deep bottom- and shallow bottom-type container configurations by folding along prescribed ruled lines, forming a protruding part on the circumferential wall surface and forming undistorted smooth surfaces; and to provide a manufacturing method thereof. This container usable as a deep bottom- and shallow bottom-type container in which a deep bottom-type container configuration can be changed into a shallow bottom-type container configuration, wherein said deep-bottom type container is obtained by folding, along prescribed ruled lines, a single blank having a part with prescribed ruled lines and corresponding to the bottom surface, a part sectioned into compact triangles and quadrilaterals and corresponding to a partition surface, and a part corresponding to an inner folded surface, and said deep-bottom type container comprises a protruding part formed without distortion on the circumferential wall surface; and a manufacturing method thereof.

10 Claims, 9 Drawing Sheets

(51) Int. Cl.

| | |
|---|---|
| ***B65D 5/355*** | (2006.01) |
| ***B65D 5/24*** | (2006.01) |
| ***B65D 5/02*** | (2006.01) |
| ***B31B 1/16*** | (2006.01) |
| ***B31B 1/30*** | (2006.01) |
| ***B31B 3/74*** | (2006.01) |

(56) References Cited

U.S. PATENT DOCUMENTS

| | | | | |
|---|---|---|---|---|
| 1,308,793 | A * | 7/1919 | Luellen | 229/4.5 |
| 1,756,478 | A * | 4/1930 | Batdorf | 493/159 |
| 2,459,073 | A * | 1/1949 | Hamilton | 229/400 |
| 3,423,008 | A * | 1/1969 | Mykleby | 229/110 |
| 3,833,113 | A * | 9/1974 | Osier | 206/216 |
| 5,862,977 | A * | 1/1999 | Hirano | 229/5.82 |
| 6,237,845 | B1 | 5/2001 | Hashimoto et al. | |
| 6,595,409 | B2 * | 7/2003 | Hashimoto et al. | 229/108 |
| 2002/0038816 | A1 | 4/2002 | Hashimoto et al. | |

FOREIGN PATENT DOCUMENTS

| | | | |
|---|---|---|---|
| JP | 52-22340 | U | 2/1977 |
| JP | 2000-309326 | A | 11/2000 |
| JP | 2002-002669 | A | 1/2002 |
| JP | 2003-040244 | A | 2/2003 |

OTHER PUBLICATIONS

English Translation of Written Opinion of the International Search Authority for PCT/JP2011/064135 dated Sep. 13, 2011.

* cited by examiner

CONTAINER USABLE AS A DEEP BOTTOM AND SHALLOW BOTTOM TYPE CONTAINER, AND MANUFACTURING METHOD THEREOF

TECHNICAL FIELD

The present invention relates to a container that can be employed as a deep container for serving fast food, catered meal, delicatessen and preserved foods, and can also be employed as a tray-like dish when the pleats along the upper opening of the deep container is opened to change the form of the container from a deep container to a shallow container, and that serves as both a deep container and a shallow container because the form can be changed, and is also appropriate for a gift packaging container because the smooth curved sheet face provides a unique, good appearance, and also relates to a manufacturing method for this container.

BACKGROUND ART

Conventionally, paper containers are frequently employed as beverage cups, food trays, etc., and most of these containers are provided by a molding method using bonding or thermal welding. When an adhesive or thermal welding is employed, deep containers (deep cups) can be produced. Further, a drawing process for thermoplastic resin laminated paper, or a bulk molding compound forming process using a paper making press apparatus, for emulsifying pulp fiber with a solution, is employed; however, either method is not appropriate for a process for changing a container form, and the obtained product is a thick container, such as an egg container, that has a low commercial value in quality appearance.

A method for manufacturing a deep container by folding a single sheet of blank without employing an adhesive is introduced in patent literature 1, patent literature 2 and patent literature 3. However, patent literature 1 is the invention that discloses paper tableware with a raised bottom, and this tableware is efficient as a disposable tableware used in a campsite, etc., but is inferior in fasionability, and is inappropriate for re-heating by a microwave oven because of the shape of the raised bottom.

Patent literature 2 discloses a deep paper container, as shown in FIGS. 8 and 9, that is produced by integrally molding a single sheet of blank B, and that includes a polygonal bottom face D, an opening top and a peripheral wall face A, which is formed by alternately arranging spiral inner folded faces 4 and partition faces 3 circumferentially along the bottom face, and for which the individual partition faces are joined together along the side edges, and are raised circumferentially with a predetermined inclination, from the peripheral edge of the bottom face to the top opening edge, and the individual inner folded faces are folded in half, into a triangular shape where the vertex contacts the peripheral edge of the bottom face, and overlap the inner surfaces of the corresponding partition faces, and also discloses the manufacturing method for the container. Patent literature 3 is substantially the same.

As shown in FIG. 9, according to patent literature 2, a blank is disclosed, wherein a polygonal portion 12 corresponding to a bottom face is located in the center, and quadrilateral portions 13 corresponding to partition faces of a peripheral wall and triangular portions 14 corresponding to inner folded faces are alternately arranged in a radial manner; the partition face equivalent portions 13 are folded into two in a triangular shape, while small triangles and small quadrilaterals are not defined with ruled lines in the partition face equivalent portions, and therefore, a pattern consisting of raised portions is not provided on the peripheral wall of the container, as shown in FIG. 8. Since the containers disclosed in these patent literatures do not define space with respect to the table of a microwave oven, unlike the container disclosed in patent literature, it is assumed that microwave cooking for the contents can be effectively performed.

However, for these containers, the thickness of paper used for container formation affects the external appearance and the function of a container, and in a case wherein thin paper is employed as a blank, a folding process for obtaining a beautiful external appearance is enabled, while there is still a problem on the function serving as a container, and in a case wherein thick paper is employed, a resistance to bending is high and distortion, such as deformation of an unexpected portion, occurs, and therefore, it is difficult to maintain a desired shape.

When the inventor of the present invention employed the paper container manufacturing method disclosed in patent literature 2, and attempted to fold a sheet of paper pulp having a thickness of 150 microns, the inventor found that it was not easy to make a crease along mountain fold lines and valley fold lines, and the container tended to be open outward. For the reason, the thickness of the product was increased by four or five times of the blank at the individual corner points of the polygonal bottom face where mountain folds and valley folds overlapped, and the folded shape could not be maintained unless considerable compressive stress and considerable pressure for smoothing out the portion were applied.

The paper pulp is an aggregate where natural macromolecules consisting of cellulose are three-dimensionally intertwined. Therefore, when a bending stress, a compressive stress and a tensile stress are applied to this structure, the folded form can not be easily maintained due to the factors, such as a strain reaction of the three-dimensional structure and a long period required for relaxation of the polymer chain from the deforming stress, and the structure tends to be returned to the original shape. In paperfolding, a tensile stress is exerted to the mountain fold, while a compressive stress is exerted to the valley fold. Further, these stresses are proportional to the third power of the thickness of the paper. Only a small thickness of paper is critical for the difficulty of paperfolding. For example, a folding process can be appropriately performed for a paper sheet having a thickness of about 10 microns, while eight times as high as the stress is required for paper of 20 microns.

In the processing for folding practically thick paper pulp and meeting the adjacent inner folded faces to form a deep container, distortion, such as unexpected deformation or so-called collapse, is observed near the bottom part. Therefore, after the deep container is formed, a post-process for pressing the bent portion, for example, is required as a countermeasure in order to correct the distortion. More specifically, in a case wherein a blank disclosed in patent literature 2 or 3 is to be folded along the mountain fold and valley fold lines to form a container, a curved sheet surface (HP surface) that is smooth in the out-of-plane direction is required for the quadrilateral, partition face equivalent portions. Therefore, due to an excessive twist angle formed by the two opposite short sides, an irregular rough distorted surface tends to occur along the two opposite long sides, and especially, convex distortion at the portion near the bottom face equivalent portion is most remarkable. As a result, since it is difficult to form the original, smooth HP surface, various form correction means must be employed after the container has been formed by folding the blank.

It should be noted that, for a quadrilateral flat sheet that can be curved and deformed in the out-of-plane direction, the HP (Hyperbolic Parabolid) surface is a smooth, curved sheet surface that is obtained by rotating the two opposite sides each other in the out-of-plane direction, while these two sides are maintained substantially linear, and that can be returned and restored to the quadrilateral flat sheet by rotation. Furthermore, in the description in patent literature 2 or 3, automatic formation can be performed by employing a cavity with a protrusion and a punch with a groove; however, the embodiments and the manufacturing methods are not provided on the assumption of the performance of a mechanical press formation, and it is reasonable to believe that manual folding is performed.

Paper containers, such as paper cups, are produced by the formation method for adhering the bottom part and the wall part (barrel part), while deep containers are produced by folding a single blank, and therefore, a large amount of materials, such as paper, is required and the formation speed is low, so that the commercial value of a container produced for the same purpose is low, and even in a case wherein a good appearance of the HP surface formed on the peripheral face is obtained by various form correction means, the competitive power on the market is unfortunately still low. Therefore, a further development of the shape and form of a container produced by folding a single sheet of blank has been requested for preventing unexpected deformation and distortion during the folding process, and for utilizing in many fields the essential, beautiful appearance and the function of the HP surface.

CITATION LIST

Patent Literature

PTL 1: Japanese Patent Laid-Open Application No. 2003-40244

PTL 2: Japanese Patent Laid-Open Application No. 2000-309326

PTL 3: Japanese Patent Laid-Open Application No. 2002-2669

SUMMARY OF INVENTION

Technical Problem

While taking into the above described shortcomings, the present invention is proposed as a result of the further study of improvement on commercial values of the products, and provides a container form, completely different from the form of a conventional container, that additionally includes a practical value, and therefore, can be employed not only as a deep container where various contents can be stored, but also as a shallow container, such as tableware, and that can be changed in shape between the two types. The objective of the present invention is to provide a container, serving as both a deep container and a shallow container, for which a material is folded by press molding using dies to obtain a raised pattern on the peripheral wall and to provide an undistorted, smooth curved sheet surface, and which can be changed in shape as a deep container, or as a shallow container, as desired.

Solution to Problem

For the invention according to claim 1, a container, capable of serving as both a deep container and a shallow container, that is produced by integrally molding a single blank B, and that includes a polygonal bottom face D, an open upper face U and a peripheral wall face A, which is formed of spiral inner folded faces 4 and partition faces 3 that are alternately arranged along the bottom face in a peripheral direction, and for which the individual partition faces are joined together along side edges and are circumferentially raised, with a predetermined inclination, from a peripheral edge of the bottom face to an edge of an upper opening, and the inner folded faces are folded and overlap inner surfaces of the individual partition faces to contact vertexes on the peripheral edge of the bottom face, is characterized in that:

for a single sheet of the blank B, a bottom face equivalent portion 12 is defined in a polygonal shape, or a rounded polygonal shape, by forming a ruled line in the center of the blank B, partition face equivalent portions 13 are formed, in each of which a quadrilateral portion is defined by a ruled line, and is segmented along a ruled line into a small triangle 15, which employs, as one side, an outer edge side of the bottom face equivalent portion, and a small quadrilateral 16, which employs, as one side, another side of the small triangle, inner folded face equivalent portions 14 are defined, by forming ruled lines, in a triangular shape that employs, as vertexes, corners at an outer edge of the bottom face equivalent portion, and the partition face equivalent portions and the inner folded face equivalent portions are alternately arranged, as constituents, in a spiral manner, or in a radial manner;

the blank B is folded, by press molding using dies, along mountain fold and valley fold lines that define the individual equivalent portions 12, 13 and 14 to produce a deep container 1 where equilateral triangular raised portions 5 and rhombic raised portions 6 are formed at a bottom portion of the peripheral wall face A; and when the upper opening of the deep container is extended outward by using fingers, a shape of the deep container is changed to a shape of a shallow container 2.

The invention according to claim 2 is characterized in that:

the small triangle 15 is defined by forming a ruled line to each of the partition face equivalent portion 13, and contiguously, two to five small quadrilaterals 16 are defined in a peripheral direction by forming ruled lines to provide the equilateral triangular raised portion 5 and two to five of the rhombic raised portions 6 on the peripheral face wall. The invention according to claim 3 is characterized in that the small triangles 15 are defined by forming ruled lines in the individual partition face equivalent portions 13, and the equilateral triangular raised portions 5 are provided on the peripheral wall face. The invention according to claim 4 is a container, capable of serving both as a deep container and a shallow container, characterized in that:

small trilateral FIG. 17, each employing a linear line, which is an outer edge side of the bottom face equivalent portion, and a curved line as one of the remaining sides, are defined in the individual partition face equivalent portions 13 by forming ruled lines, and triangular raised portions 7 consisting of two linear sides and one curved side are provided on the peripheral wall face.

The invention according to claim 5 is characterized by a container, capable of serving as both a deep container and a shallow container, wherein the shallow container 2, obtained by changing the shape of the deep container 1, is closed inward from the bottom face of the container toward the upper opening by using the palms of hands, and is returned to the shape of the deep container.

The invention according to claim 6 is characterized in that:

a material for the blank B is one of paper containing pulp only, with a thickness of 50 microns or more, multi-layer paper, resin laminated paper, metal foil laminated paper, resin coated paper, synthetic paper, plastic sheets, metal sheets and metal foil. The invention according to claim 7 is a container, capable of serving as both a deep container and a shallow container, characterized in that the material of the blank B is synthetic paper that includes, as a base material layer, biaxially oriented film of a thermoplastic resin.

The invention according to claim 8 is characterized in that the deep container 1 includes a lid member that engages at least an inner face of the upper opening, and the invention according to claim 9 is a container, capable of serving as both a deep container and a shallow container, characterized in that the deep container 1 is obtained by employing the fingers of a person and folding, along mountain and valley fold lines, a single sheet of the blank B where the ruled lines are formed.

For the invention according to claim 10, a method for manufacturing a container serving as both a deep container and a shallow container is characterized by:

cutting a single sheet of base paper P into a predetermined shape to obtain a blank B;

forming, in the center of the blank, a bottom face equivalent portion 12 that corresponds to a bottom face D of a container, and forming a ruled line so that the bottom face equivalent portion is shaped like a polygon or a rounded polygon;

forming partition face equivalent portions 13 that are extended spirally or radially from the center of the blank in a peripheral direction of the blank, and that correspond to partition faces 3 of the container, and forming ruled lines to form quadrilaterals that each employ, as one side, the individual outer edge side of the bottom face equivalent portion;

forming ruled lines in each of the quadrilaterals in order to internally define a small triangle 15, which employs as one side one of the sides of the bottom face equivalent portion, a small triangle or a single or a plurality of small quadrilaterals 16, or a small trilateral FIG. 17 that employs a curved line as one of sides;

forming inner folded face equivalent portions 14 that are extended spirally or radially from the center of the blank in the peripheral direction of the blank, and that correspond to inner folded faces 4, and forming ruled lines to form triangles that employ, as vertexes, corners at the outer edge of the bottom face equivalent portion;

folding, along mountain fold and valley fold lines, the blank having the ruled lines by press molding using dies, or by using the fingers of a person, and producing a deep container 1 where equilateral triangular raised portions 5, rhombic raised portions 6 and trilateral raised portions 7 that each employ a curved line as one side are formed across a peripheral wall face; and thereafter, expanding the upper opening of the deep container by the fingers of a person, as desired, to change the shape to a shallow container 2, and closing the obtained shallow container inward from the bottom face toward the opening by using palms of hands to return the shape to the deep container.

Advantageous Effects of Invention

According to the container of the present invention, a folding process is performed by press molding using dies, and further, for this invention, the small triangle 15 employing, as one side, the individual outer edge of the bottom face equivalent portion 12, the small triangle or a single or a plurality of small quadrilaterals 16, or the small trilateral FIG. 17 employing a curved line as one of the sides, are defined in the individual quadrilateral partition face equivalent portions 13 of the blank. Therefore, according to the present invention, the fixed pattern of the container, either a deep container or a shallow container, can be maintained, and a pattern of the equilateral triangular raised portions, rhombic raised portions or the trilateral raised portions having a curved line as one side is formed across the peripheral wall of the container, so that unexpected deformation due to folding can be prevented, and a smooth, curved sheet surface can be provided across the peripheral wall face.

The container of this invention can be changed to the shape of a shallow container, and the shallow container is a container wherein the partition faces and the inner folded faces adjacent to each other are maintained in the steady state with a predetermined opening angle. As for a deep container obtained by press molding using dies, when the upper opening is expanded by using the fingers of a person, the upper opening is released from the fixed pattern, and the container shape can be changed to a shallow container, or when the obtained shallow container is closed inward from the bottom face toward the opening using the palms of the hands, the container shape can be returned to the deep container. With this structure, the container according to the present invention can be employed as a deep container, and also as a shallow container, such as tableware.

According to the container of this invention, since the HP surface is formed, a beautiful external appearance can be provided, and after the blank is folded, a form correction process, such as correction for the distorted wall face of the container, is not required. Furthermore, a shallow container according to this invention can be employed as tableware, such as a tray or a dish, or a cooking container, and the discarding process is easier.

Further, since the deep container of this invention includes a lid member that engages at least the inner face of the upper opening, a folding process can be manually performed by the fingers of people. According to the present invention with this structure, the obtained container is resistant to external stress deformation, and is also well-designed and easy to carry around. Additionally, the container can be produced while enjoying manual paperfolding, and the container blank can be employed for learning a three-dimensional structure as childhood education materials.

DESCRIPTION OF EMBODIMENTS

Figure 1:
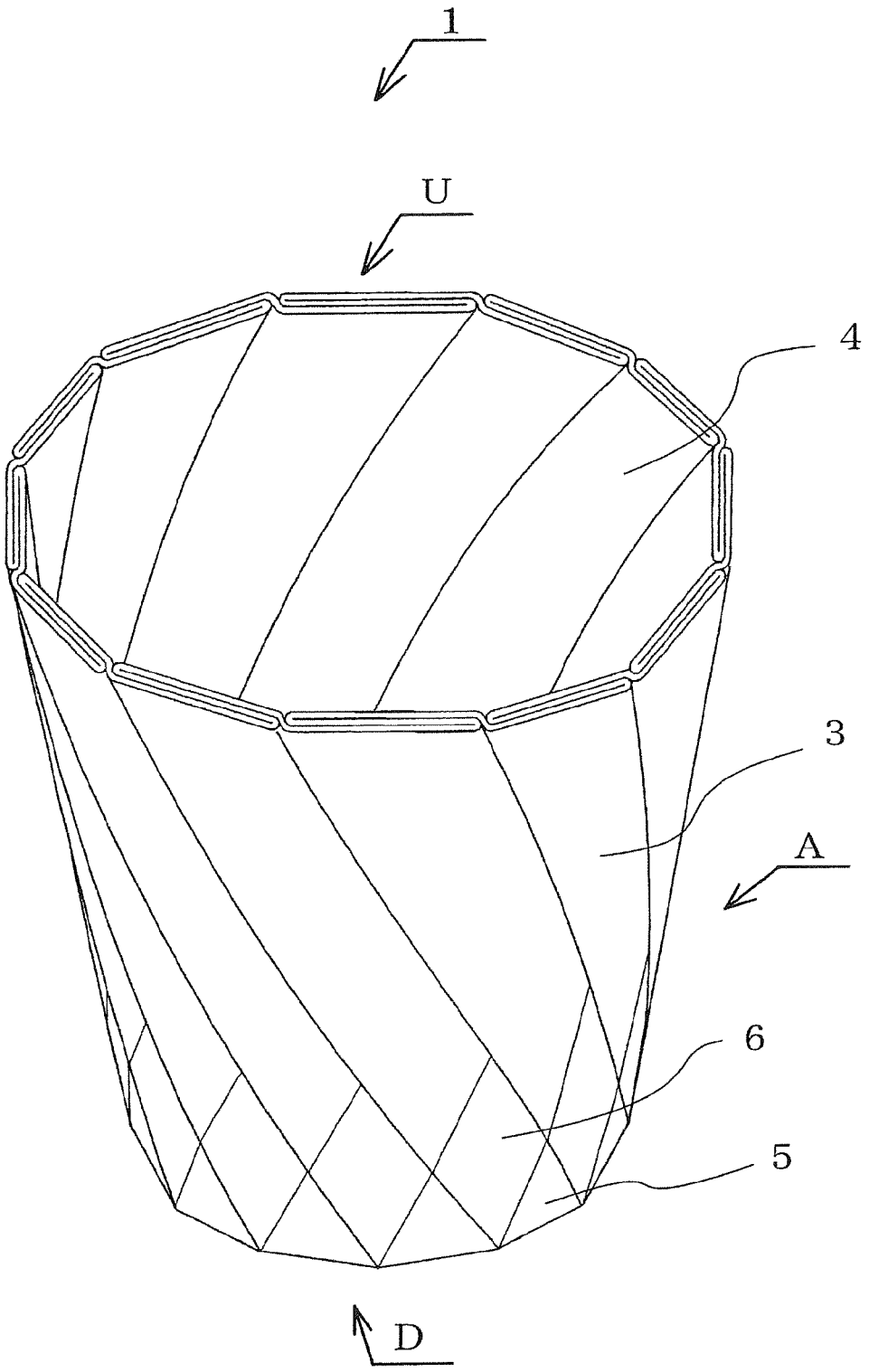
FIG. 1 is a perspective view of an example configuration for a first embodiment of a deep container according to the present invention.
Figure 2:
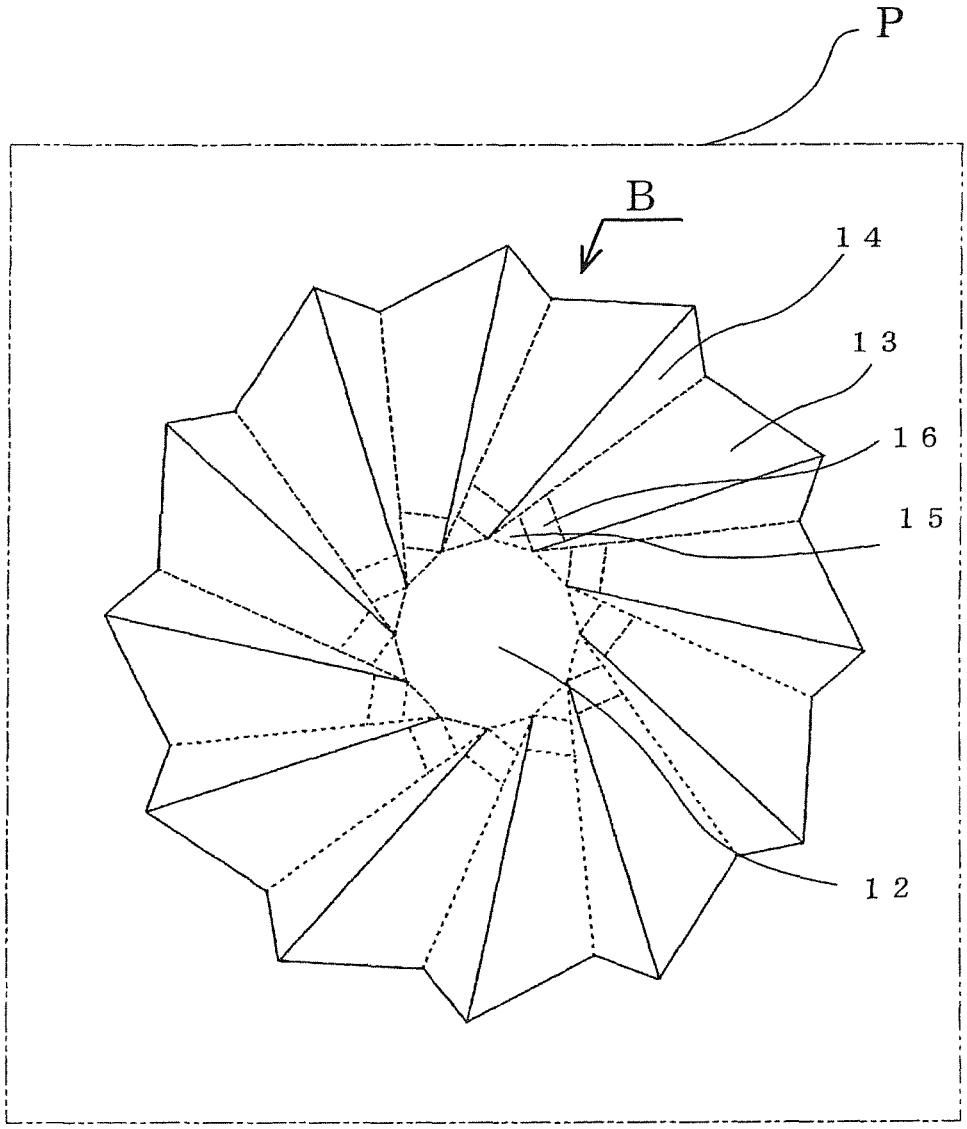
FIG. 2 is an expansion plan for the container according to the present invention, showing an example arrangement for ruled lines formed for a blank for the first embodiment.
Figure 3:
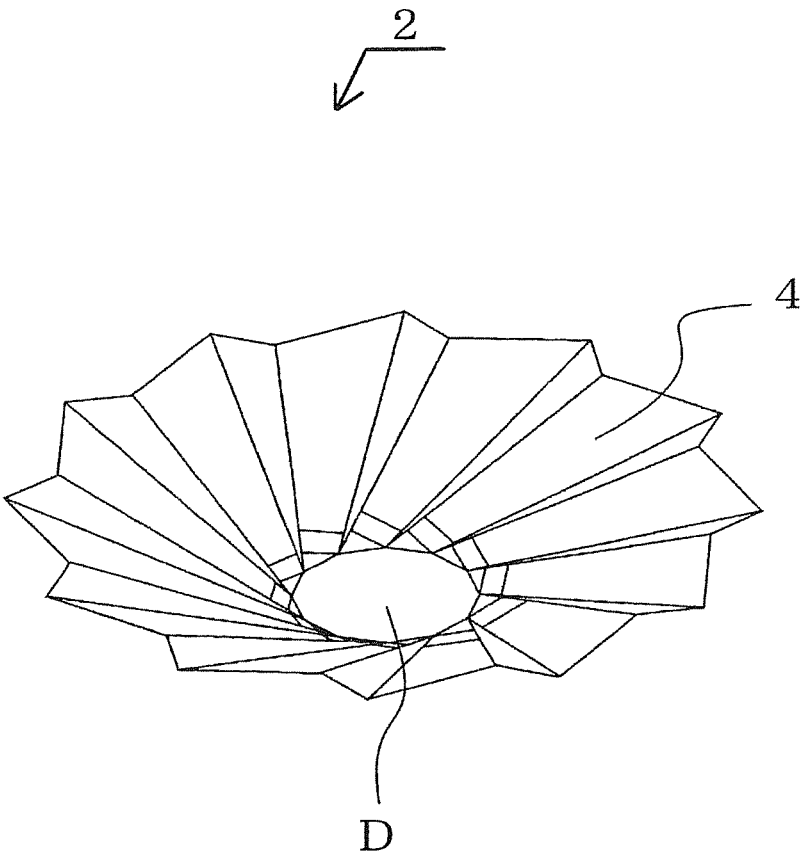
FIG. 3 is a perspective view showing an example configuration of a shallow container according to the present invention.

The embodiments for a container according to the present invention that can serve as both a deep container and a shallow container will now be described in detail, while referring to the accompanying drawings. FIG. 1 is a perspective view illustrating an example configuration for a first embodiment of a deep container according to the present invention, FIG. 2 is an expansion plan for the container, showing an example arrangement for ruled lines formed for a blank according to the first embodiment, and FIG. 3 is a perspective view of an example configuration for a shallow container according to the present invention. In FIGS. 2, 5, 7 and 9 that are expansion plans for the container, the outline is indicated by a solid line, and in these drawings, mountain fold lines are indicated by solid lines, while valley fold lines are indicated by broken lines. In FIG. 1, U denotes the upper opening of a container, D denotes the bottom face of the container, A denotes the peripheral wall of the container, 3 denotes each partition face of the peripheral wall, 4 denotes each inner folded face of the peripheral wall, 5 denotes each equilateral triangular raised portion formed across the peripheral wall, and 6 denote each rhombic raised portion. For the container of this invention, the equilateral triangular raised portions and the rhombic raised portions are steadily formed on the peripheral wall, while in the prior art, any raised portions are not formed, as shown in FIG. 8.

As shown in FIG. 2, mountain fold lines and valley fold lines are formed for predetermined portions of a blank that is employed for producing the deep container in FIG. 1. Referring to FIG. 2, P denotes a sheet of base paper that is to be cut into a predetermined shape for preparing a blank, B denotes a blank used to form a container, 12 denotes a bottom face equivalent portion that corresponds to the bottom face D of the container, 13 denotes a partition face equivalent portion that corresponds to each of the partition faces 3, 14 denotes an inner folded face equivalent portion that corresponds to each of the inner folded faces 4, 15 denotes a small triangle defined in the partition face equivalent portion, and 16 denotes a small quadrilateral defined in the partition face equivalent portion. The bottom face equivalent portion 12 of the container is located in the center of the blank B, and a valley fold line is provided along the outer edge of a polygon.

Each of the partition face equivalent portions 13 is shaped like a quadrilateral, which is extended outward in the peripheral direction by employing, as one side, one of the outer edges of the bottom face equivalent portion, and the quadrilateral frame of the partition face equivalent portion is divided into sections in a direction from the center to the outer periphery to obtain the small triangle 15 and the small quadrilateral 16. Along the boundary between these sections, a valley fold line is formed, except for one side of the partition face equivalent portion. As shown in FIG. 1, the individual partition face equivalent portions 13 serve as the partition faces 3 of the outer peripheral wall face of the container that is provided as a final product, and the small triangles and the small quadrilaterals defined in the quadrilateral frames of the individual partition wall equivalent portions provide, at the bottom portion of the peripheral wall of the container, a pattern consisting of the equilateral triangular raised portions 5 and the rhombic raised portions 6.

Further, in FIG. 2, for each partition face equivalent portion 13, only one small quadrilateral is defined in the quadrilateral frame; however, sequentially after the small triangle 15 is defined in the quadrilateral frame of the partition wall equivalent portion, two or more of small quadrilaterals, preferably two to five small quadrilaterals, can be formed in the peripheral direction. As a result, one equilateral triangular raised portion 5 and two or more, or two to five, rhombic raised portions can be formed on one face portion of the peripheral wall. Therefore, the occurrence of distorted peripheral wall face can be prevented, and the HP surface like a smooth curved sheet can be formed to provide a beautiful external appearance.

Each of the inner folded face equivalent portions 14 is shaped like a triangle, for which the corner at the outer edge of the bottom face equivalent portion is employed as a vertex, and is extended in the outer peripheral direction by forming a mountain fold line for one side, and forming a valley fold line for another side. As shown in FIG. 1, for the container provided as a final product, the inner folded face equivalent portions 14 serve as the inner folded faces 4 of the internal peripheral wall with substantially overlapping the adjacent partition faces 3 in the same plane (surface-to-surface contact). Furthermore, the partition face equivalent portions 13 and the inner folded face equivalent portions 14 are alternately arranged, as constituents, either spirally or radially, for one sheet of the blank B.

Figure 4:
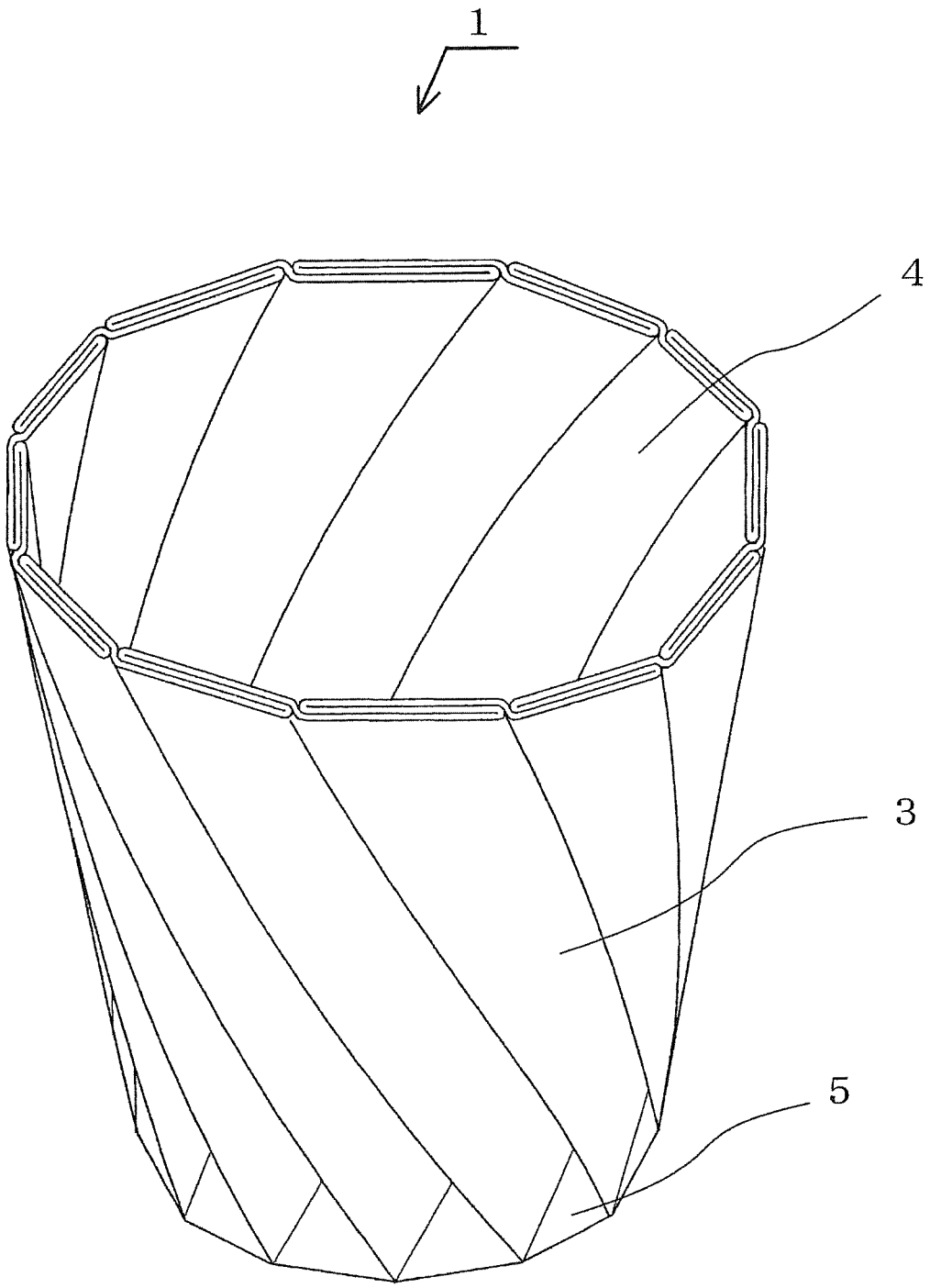
FIG. 4 is a perspective view of an example configuration according to a second embodiment for a deep container according to the present invention.
Figure 5:
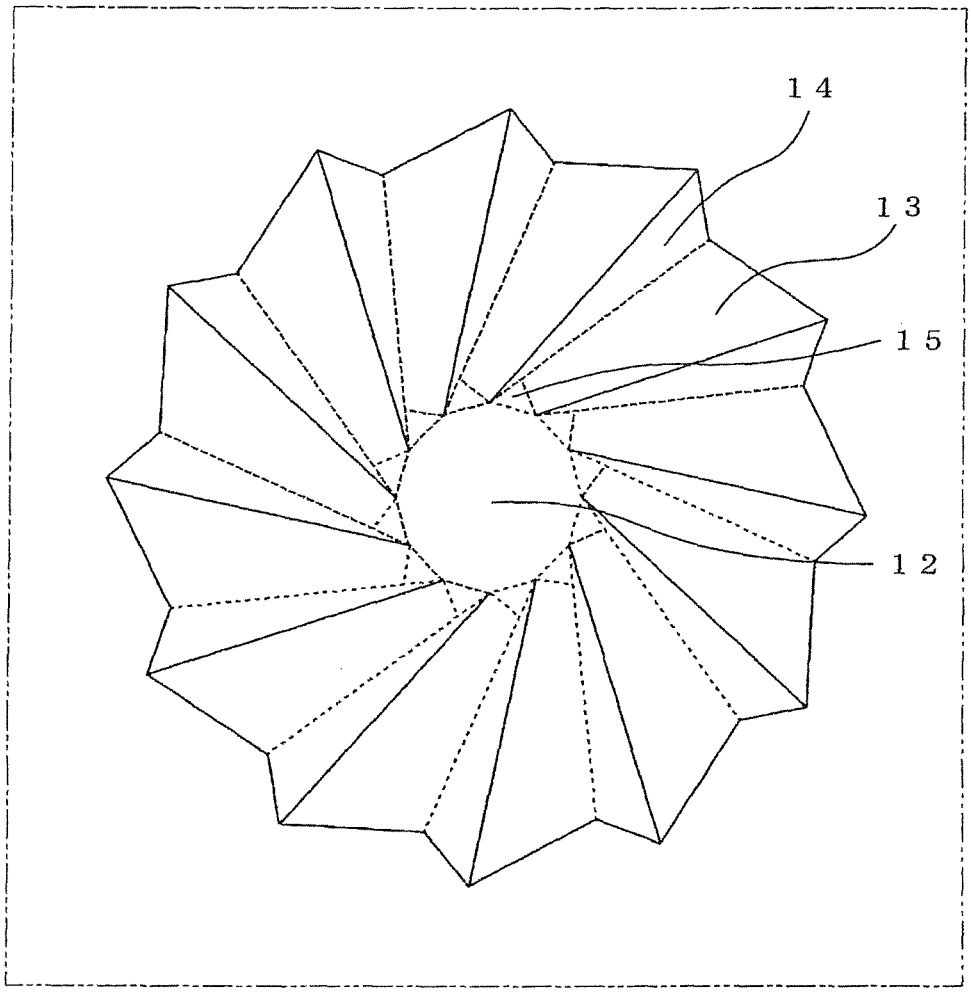
FIG. 5 is an expansion plan for the container according to the present invention, showing an example arrangement for ruled lines formed for a blank for the second embodiment.

FIG. 4 is a perspective view of an example configuration for a second embodiment of a deep container according to the present invention, and FIG. 5 is a diagram illustrating an example arrangement for ruled lines formed for a blank according to the second embodiment. In this invention, one small triangle 15 can be defined in the quadrilateral frame of each partition face equivalent portion 13. As a result, only equilateral triangular raised portions 5 are formed at the bottom portion of the peripheral wall.

Figure 6:
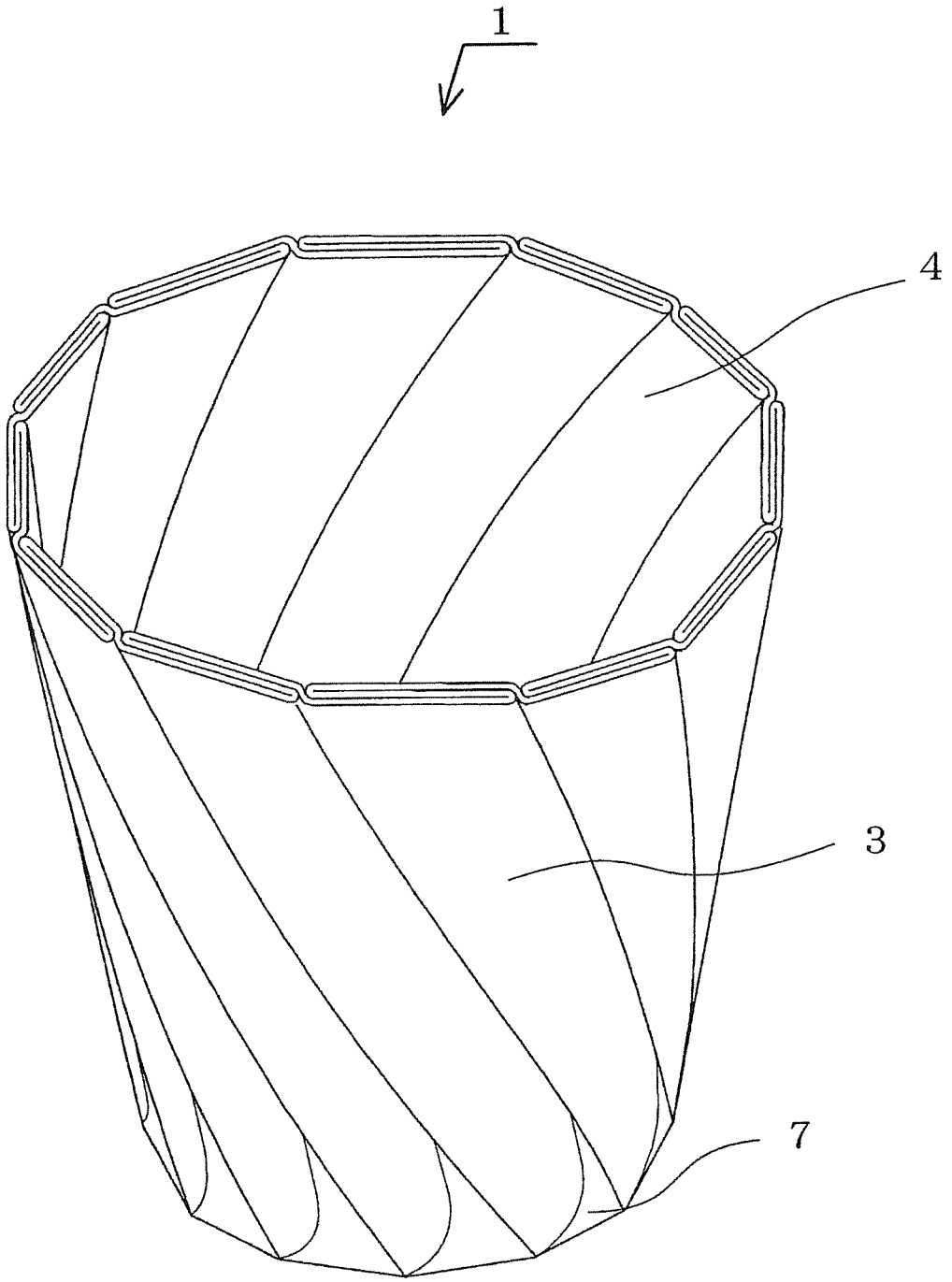
FIG. 6 is a perspective view of an example configuration according to a third embodiment for a deep container according to the present invention.
Figure 7:
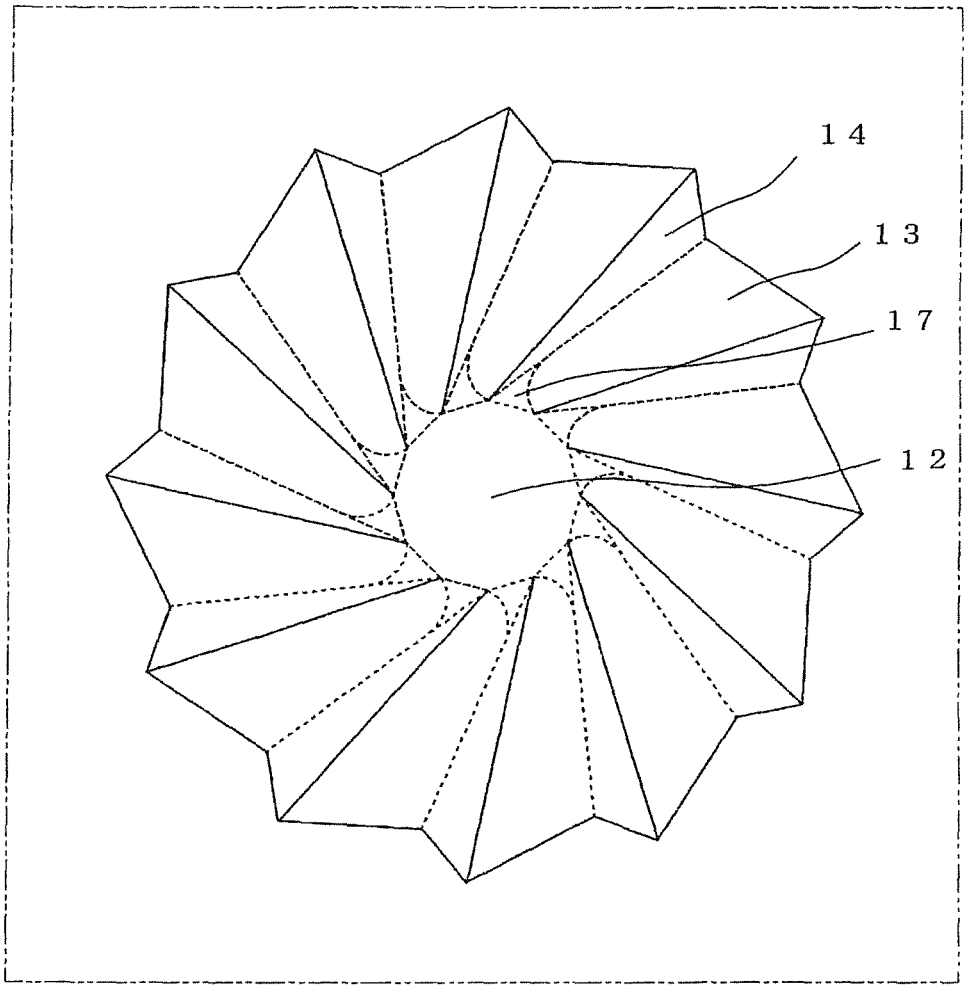
FIG. 7 is an expansion plan for the container according to the present invention, showing an example arrangement for ruled lines formed for a blank for the third embodiment.
Figure 8:
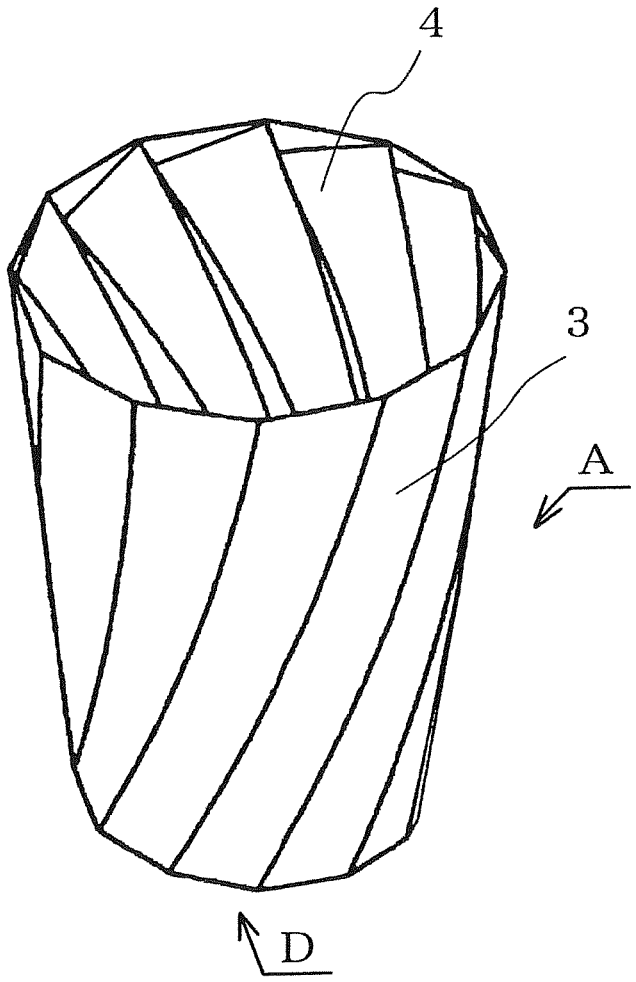
FIG. 8 is a perspective view of the configuration of a deep container according to prior art.
Figure 9:
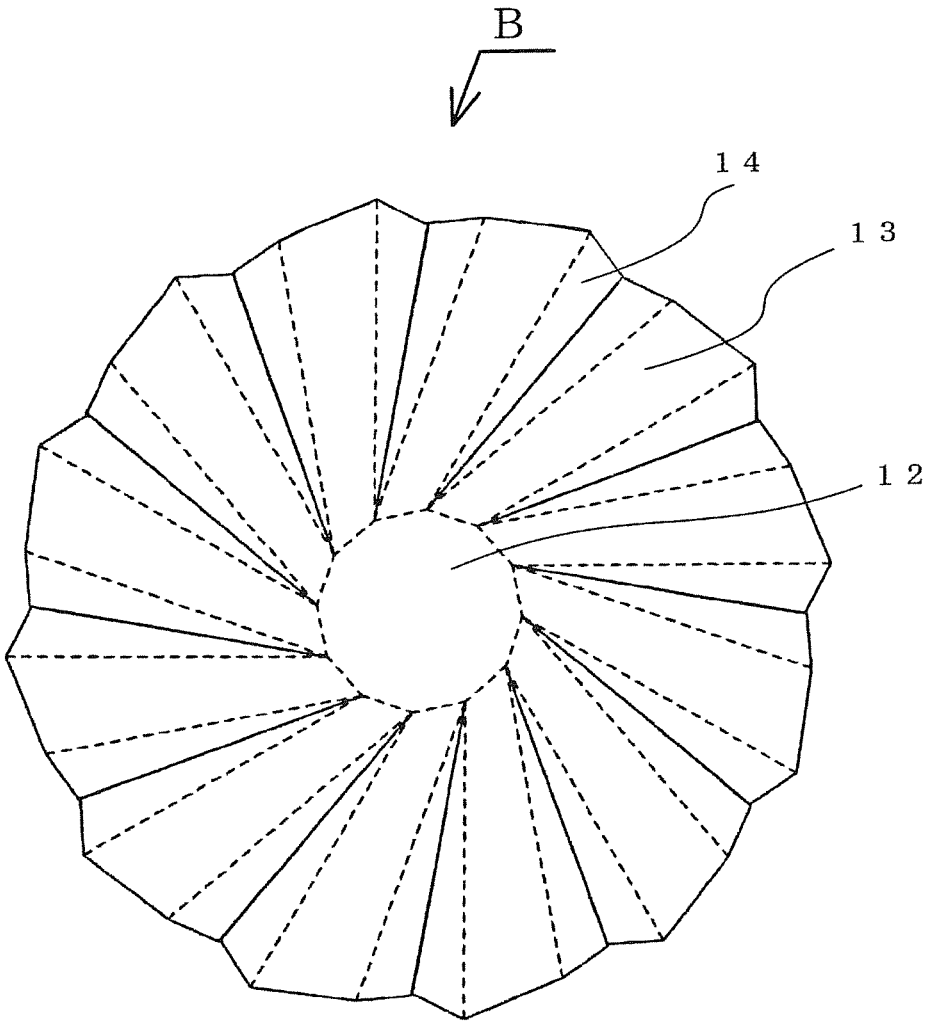
FIG. 9 is an expansion plan for the container according to the prior art, and showing the arrangement of ruled lines formed for a blank for the prior art.

FIG. 6 is a perspective view of an example arrangement for a third embodiment of a deep container according to the present invention, and FIG. 7 is a diagram illustrating an example arrangement for ruled lines formed for a blank according to the third embodiment. In this invention, the quadrilateral frames of partition face equivalent portions 13 can be divided into sections to form small trilateral FIG. 17, each of which employs, as one side, a linear side along the outer edge of a bottom face equivalent portion, and a curved side as another side. As a result, trilateral raised portions 7 that each employ two linear sides and one curved side are formed at the bottom portion of the peripheral wall.

For the second or the third embodiment of the present invention, the equilateral triangular raised portions 5 or the trilateral raised portions 7, formed at the bottom portion of the peripheral wall, can be employed to prevent the occurrence of the distortion of the peripheral wall, and the HP surface can be obtained to provide a beautiful external appearance. According to the present invention, the shape of a segment in the quadrilateral frame of the partition face equivalent portion 13 is not limited to a small triangle, a small trilateral figure or a small quadrilateral, and various other shapes and sizes of small triangles, small trilateral figures and small quadrilaterals may be employed.

The container of the present invention described above is produced by integrally molding a single sheet of blank B, and includes the polygonal bottom face, the upper opening, and the peripheral wall formed of the spiral inner folded faces 4 and the partition faces 3, which are alternately arranged in the peripheral direction along the bottom face, and the individual partition faces are raised from the peripheral edge of the bottom face to the edge of the upper opening with a predetermined inclination by joining the side edges together, while the inner folded faces are folded and overlap the inner faces of the partition faces to contact the vertexes the peripheral edge of the bottom face.

Further, one sheet of the blank B is folded by mechanical means, such as press molding using dies, along the mountain and valley fold lines that are formed at the boundaries of the individual equivalent portions 12, 13 and 14, assigned to the blank B, and of the small triangles 15, the small quadrilaterals 16 and the small trilateral FIG. 17 that are defined in the quadrilateral frames of the partition face equivalent portions, and thus, the deep container of the present invention is obtained. It should be noted that the blank B with the ruled lines can also be manually folded along the mountain and valley fold lines to obtain the deep container of this invention. The forming process of the deep container can be performed with enjoyment in the paperfolding manner.

FIG. 3 is a perspective view of an example configuration for a shallow container according to the present invention, showing the state wherein the deep container of the first embodiment of this invention in FIGS. 1 and 2 has been changed to the form of a shallow container. However, according to the present invention, it goes without saying that the deep container for the embodiment wherein small triangles are defined in the quadrilateral frames of the partition face equivalent portions, and contiguously to each of the small triangles, two or more small quadrilaterals are defined in the peripheral direction, the deep container for the second embodiment shown in FIGS. 4 and 5, and a deep container for a third embodiment shown in FIGS. 6 and 7, can be changed to the forms of shallow containers (none of the forms shown). The shallow container is a container in the state wherein, as shown in FIG. 3, the opening portion is largely extended with a predetermined open angle formed by the partition faces and the inner folded faces that are adjacent to each other.

When the upper opening of the deep container is widened by using the fingers of a person, the upper opening portion can be released from the fixed form to change the container form to a shallow container. Conversely, when the thus obtained shallow container is closed inward in a direction from the bottom to the upper opening by using the palms of the hands, the container form can be returned to a deep container. In other words, the container of the present invention can be easily changed to the deep container form, or the shallow container form, as desired, and a user can employ the product as a deep container, or a shallow container. Further, a process for changing the container form to a deep container or a shallow container can be manually performed, and can be performed with interest in the paperfolding manner as performed for a process for shaping a deep container.

For the present invention, a lid that engages at least the inner wall face at the opening of the deep container can be provided. With this lid, a container resistant to external stress deformation of the container can be obtained. Furthermore, when the top of the container is covered with a transparent lid, the decorativeness of the container is also obtained, and it is helpful to carry the container. Further, since each of the inner folded faces at the opening of the deep container has a form where three surfaces contact each other by folding the inner folded face equivalent portion in half, and overlaying the partition face equivalent portion located outside, it is preferable, while taking the lid engagement process into account, that a lid be shaped so that the contact area relative to the inner side wall is large. For a general paper cup, the contact faces for the inner wall face and for the outer wall face have the same shapes and the same areas; however, as described above, for the present invention, the lid that has a large contact area relative to the inner wall face is appropriate. The general design for the shape of the lid, such as a flat plate type or a dome type, is employed.

A preferable material for the lid employed for this invention is paper, or a transparent resin, such as a polylactic acid resin, an amorphous polyester resin, an oriented polyester resin, an oriented polystyrene resin or a biaxially oriented polypropylene resin; however, the material is not limited to these, and flexible polyethylene, polypropylene or thermoplastic elastomer can also be employed. The lid is formed by performing injection molding, vacuum forming, or pressure forming. Further, in the case of foods or the contents with strong scents, a gas barrier transparent material or a gas barrier coating transparent material is selected. Moreover, in the present invention, a covering material that protects the outer peripheral face for prevention of burns, for example, can be attached, and as a result, as well as for the case of the lid, a container that can be resistant to external stress deformation of the container can be obtained, and the decorativeness can also be obtained.

The material of the blank B of this invention can be selected from, for example, paper made from pulp only with a thickness of 50 microns or more, multi-layer paper, resin laminated paper, metal foil laminated paper, resin coated paper, synthetic paper, a plastic sheet, a metal sheet and metal foil. When the thickness of the blank material is smaller than 50 microns, folding is easily performed, and as described above, the stress is low, so that unexpected distortion, such as bending, does not occur; however, the product is not satisfactory as a self-standing deep container, and when contents are stored, the bulged side or the sagged bottom of the container occurs, and therefore, the product is not for a practical use. The thickness of the blank member is preferably 100 microns or more, and is selected in accordance with the size of the container or the contents to be stored in the container.

The material type of the blank B is a multi-layer member formed by laminating a resin, and is preferably low-density polyethylene, low-density linear polyethylene, high-density polyethylene, polypropylene, cyclic polyolefin, cyclic olefin propylene copolymer, a polyethylene terephthalate resin, an amorphous polyethylene terephthalate resin, a polybutylene terephthalate resin, a polyamide resin, such as polyamide 6, polyamide 66 or polyamide 6/10, or ethylene-vinyl alcohol copolymer, and furthermore, a material formed by depositing, on a resin, a metal, such as aluminum, alumina or silicon oxide, or inorganic oxide may also be employed. Further, for the present invention, a wax coated material is also one choice for the blank material. A more preferable type for the blank material is linear polyethylene formed by polypropylene and a metallocene polymerization catalyst, high-pressure processed polyethylene, or a mixture of metallocene catalyzed linear polyethylene and a high-pressure processed polyethylene.

Further, synthetic paper that includes, as a base material layer, a biaxially oriented film formed of a thermoplastic resin can be selected as the material of the blank B of the present invention. When such synthetic paper is employed as a material, a container that is automatically open when the lid is removed can be obtained. This attracts much interest as the use of a gift packaging container. The synthetic paper that includes biaxially oriented film as a base material layer is employed as ballot paper, and has a property that the paper is open inside a ballot box for election. When this material is employed for the present invention, an unfolding prevention band should be attached to the lid or the body of a product that is still in the form of a deep container; however, so long as the band is removed, the container is automatically changed to a shallow container form, and moreover, when an instruction message is additionally provided inside the container, the product is very appropriate as an item to convey considerate regard of a sender.

The synthetic paper that includes a biaxially oriented film as a base material layer may be one of those described in Japanese Patent Publication No. 07-051393, Japanese Patent No. 2718753 and Japanese Patent Laid-Open No. 2009-023091, all of which employ, as a base material layer, a biaxially oriented film of a thermoplastic resin. The synthetic paper material may also be either a material that includes only a base material layer of biaxially oriented thermoplastic resin film that contains a filler of 8 to 65 weight %, or a material obtained by laminating, on the obverse and reverse faces of a biaxially oriented film employed as a base material layer, paper-like layers formed of uniaxially oriented thermoplastic resin film that contains a filler, or a material obtained by laminating, on the obverse and reverse faces of the biaxially oriented film as a base material layer, paper-like layers of biaxially oriented thermoplastic layer film that contains a filler. Therefore, all of the paper types described in the above described Japanese patent publications can be employed. It is appropriate that an olefin-based resin be employed as a thermoplastic resin while taking into account the water resistance, the chemical resistance and the manufacturing cost, and polypropylene, high-density polyethylene resin, etc., is employed. It is preferable for the printability that this synthetic paper employ, as a base material layer, biaxially oriented thermoplastic resin film containing a filler, and especially preferable that tiny holes using the filler as a nucleus, i.e., microvoids, be included in the base layer material.

The container according to the present invention is obtained in the following manufacturing manner:

1. cutting a single sheet of base paper P into a predetermined shape to obtain a blank B;

2. forming, in the center of the blank, a bottom face equivalent portion 12 that corresponds to a bottom face D of a container, and forming a ruled line so that the bottom face equivalent portion is shaped like a polygon or a rounded polygon;

3. forming partition face equivalent portions 13 that are extended spirally or radially from the center of the blank in a peripheral direction of the blank, and that correspond to partition faces 3 of the container, and forming ruled lines to form quadrilaterals that each employ, as one side, the individual outer edge side of the bottom face equivalent portion, and forming a ruled line in each of the quadrilaterals in order to internally define a small triangle 15, which employs as one side the individual side of the bottom face equivalent portion, a small triangle or a single or a plurality of small quadrilaterals 16, or a small trilateral FIG. 17 that employs a curved line as one of sides;

4. forming inner folded face equivalent portions 14 that are extended spirally or radially from the center of the blank in the peripheral direction of the blank, and that correspond to inner folded faces 4, and forming ruled lines to form triangles that employ, as vertexes, corners at the outer edge of the bottom face equivalent portion;

5. folding, along mountain fold and valley fold lines, the blank having the ruled lines by press molding using dies, or by using the fingers of a person, and producing a deep container 1 where equilateral triangular raised portions 5, rhombic raised portions 6 or trilateral raised portions 7 that each employ a curved line as one side are formed across a peripheral wall face; and 6. thereafter, expanding the upper opening of the deep container by the fingers of a person, as desired, to change the shape to a shallow container 2, and closing the obtained shallow container inward from the bottom face toward the opening by using palms of hands to return the shape to the deep container.

The container according to the present invention is produced and provided by performing the processing wherein a sheet of blank B where ruled lines are formed to provide a predetermined shape is folded by using mechanical means, such as dies, to obtain a deep container, and thereafter, the thus obtained container is changed, as desired, to a shallow container form by using the fingers of a person, or the obtained shallow container is returned to the deep container form. Of course, the blank B can be folded by using the fingers to provide the deep container.

For the blank of this invention, as described above, the small triangles, the small trilateral figures, the small quadrilaterals are defined in the quadrilateral frames of the individual partition face equivalent portions 13. The quadrilateral partition faces 3 are changed to the shape like HP faces, and are arranged across the peripheral wall of the container of this invention. Due to the effects of the small triangles, the small trilateral figures and the small quadrilaterals, irregular convex distortion at the portions of the partition faces 3 adjacent to the bottom face is completely absorbed, regardless of the twist angles formed at the corners between the short sides, so that the raised portions are formed in steady shapes of predetermined small triangles and small trilateral figures, and a beautiful external appearance for the container is provided. As a result, the form correction process is not required after folding of the blank has been performed. It is preferable that conditions, such as the depth of a ruled line to be formed with respect to the thickness of a blank, and forming of a continuous or non-continuous ruled line, be optimized. Furthermore, the fixed form of the deep container of the present invention is maintained by folding and forming the blank using mechanical means, such as dies.

The blank B of this invention where predetermined ruled lines are formed is employed not only for forming a deep container, but also for forming a shallow container. The fixed form of a deep container is provided by integrally forming, in the blank folding process, the partition faces and the inner folded faces adjacent to each other in the state wherein these faces overlap substantially in the same plane (surface-to-surface contact). On the other hand, the fixed form of a shallow container is provided in the state wherein a predetermined opening angle is maintained between the partition faces and the inner folded faces (no surface-to-surface contact).

Further, after the product of the present invention has been employed as a deep container, a covering material attached to the lid member or the body portion for prevention of burns is removed, the opening portion of the container is easily extended by using the fingers, and the resultant container can be employed as a dish-like shallow container. Changing of the form for the deep container and the shallow container is reversible. When this function is focused on, development of a new market described below is possible, and therefore, the importance of the present invention is understandable.

When the deep container is changed to the form of a shallow container with a wide top open space, the shallow container can also be employed as tableware, such as a tray or a dish. For the foodservice, after the food has been served by employing the blank as a replacement of a plate, a customer who desires a doggy bag for leftover food to be carried home can manually form a container while enjoying paperfolding, and further, for the foodservice industry, there are many advantages, e.g., the expenses required for dishwashing and dish storage devices, the labor cost and the utility can be reduced, and the used containers can be discarded without adversely affecting the environmental problems. It goes without saying that more effects can be obtained by employing a laminated blank where a pattern is printed in consonance with the strategy of the food restaurant that changes the meal menu for every season or for each event.

The container can also serve as both a cooking container and an eating utensil, e.g., can be employed as a mold for preparing baked sweets, such as pudding, muffin and chiffon cake, or as a replacement of a tray for eating. In fast food and delicatessen shops, food is served in the deep container of this invention, and to eat the food, the container form may be changed to the shallow container. At this time, it is preferable that a hollow base of an inverted conical shape, for example, be placed at the bottom of the container to hold a seasoning, such as ketchup, mayonnaise or salad dressing, and therefore, the food can be carried without contacting the seasoning, and before eating, the base is removed so as to have a meal with the seasoning being added, so that the convenient container can be provided.

For parties where a plurality of persons participate in, a useful system for party food arrangements can also be provided whereby several types of delicatessen served in the containers of the present invention are arranged in a single basket to provide colorful effects, and the participants choose their favorite containers, and eat the food while dipping it in a seasoning on a tray. Example favorable delicatessen for parties includes fish and other seafood, meat, poultry and game, appetizers, cakes baked in ovens, salads, sandwiches like burgers and pastries like croissants, cooked rice food like paella, fruits and other desserts. When the hollow member in an inverted conical shape, for example, is placed inside the container, an unique form can be provided even in a case wherein a seasoning is not present.

The container of the present invention can perform the important function for food arrangements for parties, and overflowing served containers can demonstrate gorgeous and luxury arrangements. Further, the container of the present invention is accepted for the site of theme parks, etc., to satisfy a request for increasing the types of food to satisfy the needs of users, and also to meet the ecological concepts of the users. Furthermore, at the time of harvest of blueberries or strawberries in orchids, the containers of the invention can be employed as collection cups, and thereafter, can be unfolded and changed to the shallow container to eat the fruit, and can be folded again with the fruit debris and be discarded. Similarly, this product can be provided as an outdoor item that can be used both as a cutting board and a container.

Example 1

A sheet of base paper having a thickness of 250 microns was cut to create a blank in FIG. 2. Mountain and valley fold lines were formed radially in the peripheral direction of a polygonal bottom shaped like a dodecagon with a diameter of 95.6 mm, and valley fold lines were provided to form small triangles, each of which has the individual outer edge of the polygon as one side, and contiguously form small quadrilaterals. In the drawing, the outer line is indicated by a solid line, and mountain fold lines are indicated by solid lines, while valley fold lines are indicated by broken lines. The pressure employed for forming the ruled lines was 50 kgf/cm$^2$, and press molding was performed under the conditions of a room temperature and the humidity of 35%. Thereafter, the mountain folding and valley folding was manually performed in order to obtain a deep container with the opening diameter of 134 mm and the depth of 115 mm. The folding process for the container was very easy. The processing could be performed without any difficulty for making creases of folded portions. Small crystal patterns shown in FIG. 1, consisting of equilateral triangular raised portions and rhombic raised potions, were regularly aligned near the bottom in the circumferential direction, and further, curved lines were drawn toward the opening, and since the amount of light transmitted and the intensity of reflected light differed between the triangular portions formed by contacting three layers of the sheet and the portion formed by only one layer of the sheet, a very beautiful container was obtained. Thereafter, when the opening portion was unfolded with a small force by using the fingers, a shallow container could be obtained, and it was also confirmed that the shallow container could be changed to the form of the deep container.

INDUSTRIAL APPLICABILITY

The present invention is a multifunctional item that can be, for example, reversibly usable as an ecological packaging container and also as tableware, and can also be employed as a packaging container superior in fashionability. Further, conventional bulky containers are unfavorable for distribution, while the present invention provides environmental and economical advantages that flat blank sheets can be transported to the factory site, any technical skill is not required, and mechanical automation is easily performed. The usages described in the specification of this invention are merely examples, and it is expected that the present invention can be employed for various purposes, such as a childhood education material for learning a three-dimensional structure.

The present invention is useful as a packaging material for a gift, etc., in addition to the above described usage for food. The container having a unique curved HP face that is comparatively rigid and is superior in fashionability and design is appropriate as a gift container for, for example, preserved flowers and jewelry. Further, the container is also usable as a storage item. Further, since toys, stationeries, household articles, etc., are easily extracted from, and also easily stored in the containers, a variety of usages is available for the container. A first-in last-out method is frequently one of the storage problems. It is troublesome to extract the old stored item. One of situations that frequently occur at home is the situation wherein although many small packages of spices have been stored in a bottle, it becomes troublesome to extract the package, and a new package is purchased while the old packages have been left in the bottle for a long time without being used. Since the present invention serves as a deep container with the closed space and also as a shallow container with the open space, this type of problem is resolved. When an identification band is attached to the body of the container, as needed, management of items can be more effectively performed.

REFERENCE SIGNS LIST

1: deep container
2: shallow container
3: partition face
4: inner folded face
5: equilateral triangular raised portion

6: rhombic raised portion
7: trilateral raised portion
12: bottom face equivalent portion
13: partition face equivalent portion
14: inner folded face equivalent portion
15: small triangle
16: small quadrilateral
17: small trilateral figure
P: base paper
B: blank
D: bottom face of a container (bottom portion)
U: upper face of a container (upper opening)
A: peripheral wall

The invention claimed is:

1. A container, capable of serving as both a deep container and a shallow container, that is produced by integrally molding a single blank, and that includes a polygonal bottom face, an open upper face and a peripheral wall face, which is formed of spiral inner folded faces and partition faces that are alternately arranged along the bottom face in a peripheral direction, and for which the individual partition faces are joined together along side edges and are circumferentially raised, with a predetermined inclination, from a peripheral edge of the bottom face to an edge of an upper opening, and the inner folded faces are folded and overlap inner surfaces of the individual partition faces to contact vertexes on the peripheral edge of the bottom face, characterized in that:

for a single sheet of the blank, a bottom face equivalent portion is defined in a polygonal shape, or a rounded polygonal shape, by forming a ruled line in the center of the blank, partition face equivalent portions are formed, in each of which a quadrilateral portion is defined by a ruled line, and is segmented along a ruled line into a small triangle, which employs, as one side, an outer edge side of the bottom face equivalent portion, and a small quadrilateral, which employs, as one side, another side of the small triangle, inner folded face equivalent portions are defined, by forming ruled lines, in a triangular shape that employs, as vertexes, corners at an outer edge of the bottom face equivalent portion, and the partition face equivalent portions and the inner folded face equivalent portions are alternately arranged, as constituents, in a spiral manner, or in a radial manner;

the blank is folded, by press molding using dies, along mountain fold and valley fold lines that define the individual equivalent portions to produce a deep container where equilateral triangular raised portions and rhombic raised portions are formed at a bottom portion of the peripheral wall face; and when the upper opening of the deep container is extended outward by using fingers, a shape of the deep container is changed to a shape of a shallow container.

2. The container, capable of serving as both a deep container and a shallow container, according to claim 1 characterized in that:

the small triangle is defined by forming a ruled line to each of the partition face equivalent portions, and contiguously, two to five small quadrilaterals are defined in a peripheral direction by forming ruled lines to provide the equilateral triangular raised portion and two to five of the rhombic raised portions on the peripheral face wall.

3. The container, capable of serving as both a deep container and a shallow container, according to claim 1 characterized in that:

the small triangles are defined by forming ruled lines in the individual partition face equivalent portions, and the equilateral triangular raised portions are provided on the peripheral wall face.

4. The container, capable of serving as both a deep container and a shallow container, according to claim 1 characterized in that:

small trilateral figures, each employing a linear line, which is an outer edge side of the bottom face equivalent portion, and a curved line as one of the remaining sides, are defined in the partition face equivalent portions by forming ruled lines, and triangular raised portions consisting of two linear sides and one curved side are provided on the peripheral wall face.

5. The container, capable of serving as both a deep container and a shallow container, according to claim 1 characterized in that:

the shallow container, obtained by changing the shape of the deep container, is closed inward from the bottom face of the container toward the upper opening by using the palms of hands, and is returned to the shape of the deep container.

6. The container, capable of serving as both a deep container and a shallow container, according to claim 1 characterized in that:

a material for the blank is one of paper containing pulp only, with a thickness of 50 microns or more, multi-layer paper, resin laminated paper, metal foil laminated paper, resin coated paper, synthetic paper, plastic sheets, metal sheets and metal foil.

7. The container, capable of serving as both a deep container and a shallow container, according to claim 1 characterized in that:

the material of the blank is synthetic paper that includes, as a base material layer, biaxially oriented film of a thermoplastic resin.

8. The container, capable of serving as both a deep container and a shallow container, according to claim 1 characterized in that:

the deep container includes a lid member that engages at least an inner face of the upper opening.

9. The container, capable of serving as both a deep container and a shallow container, according to claim 1 characterized in that:

the deep container is obtained by employing the fingers of a person and folding, along mountain and valley fold lines, a single sheet of the blank where the ruled lines are formed.

10. A method for manufacturing a container serving as both a deep container and a shallow container, characterized by:

cutting a single sheet of base paper into a predetermined shape to obtain a blank;

forming, in the center of the blank, a bottom face equivalent portion that corresponds to a bottom face of a container, and forming a ruled line so that the bottom face equivalent portion is shaped like a polygon or a rounded polygon;

forming partition face equivalent portions that are extended spirally or radially from the center of the blank in a peripheral direction of the blank, and that correspond to partition faces of the container, and forming ruled lines to form quadrilaterals that each employ, as one side, the individual outer edge side of the bottom face equivalent portion;

forming ruled lines in each of the quadrilaterals in order to internally define a small triangle, which employs as one side the individual side of the bottom face equivalent portion, a small triangle or a single or a plurality of small quadrilaterals, or a small trilateral figure that employs a curved line as one of sides;

forming inner folded face equivalent portions that are extended spirally or radially from the center of the blank in the peripheral direction of the blank, and that correspond to inner folded faces, and forming ruled lines to form triangles that employ, as vertexes, corners at the outer edge of the bottom face equivalent portion;

folding, along mountain fold and valley fold lines, the blank having the ruled lines by press molding using dies, or by using the fingers of a person, and producing a deep container where equilateral triangular raised portions, rhombic raised portions or trilateral raised portions that each employ a curved line as one side are formed across a peripheral wall face; and thereafter, expanding the upper opening of the deep container by the fingers of a person, as desired, to change the shape to a shallow container, and closing the obtained shallow container inward from the bottom face toward the opening by using palms of hands to return the shape to the deep container.

* * * * *